US005950516A

United States Patent [19]

Stäb

[11] Patent Number: 5,950,516

[45] Date of Patent: Sep. 14, 1999

[54] DEVICE FOR ADJUSTING A CUTTING STICK FOR A CUTTING CYLINDER OF A ROTARY PRESS

[75] Inventor: Rudolf Stäb, Frankenthal, Germany

[73] Assignee: Albert-Frankenthal Aktiengesellschaft, Frankenthal, Germany

[21] Appl. No.: 08/968,880

[22] Filed: Nov. 5, 1997

Related U.S. Application Data

[63] Continuation of application No. 08/454,198, filed as application No. PCT/DE93/01210, Dec. 17, 1993, abandoned.

[30] Foreign Application Priority Data

Dec. 18, 1992 [DE] Germany ..... P 42 42 886

[51] Int. Cl.[6] ..... B26D 7/26

[52] U.S. Cl. ..... 83/698.51; 83/698.61; 83/674

[58] Field of Search ..... 83/698.51, 698.61, 83/674, 343; 493/368, 471, 475

[56] References Cited

U.S. PATENT DOCUMENTS

| | | | |
|---|---|---|---|
| 2,832,411 | 12/1958 | Richards | 83/663 |
| 4,147,337 | 4/1979 | Bolza-Schunemann | 270/19 |
| 4,338,087 | 7/1982 | Gregoire | 493/425 |

FOREIGN PATENT DOCUMENTS

| | | |
|---|---|---|
| 0 364 864 | 4/1990 | European Pat. Off. . |
| 1264237 | 3/1968 | Germany . |
| 61-086368 | 5/1986 | Japan . |
| 2 159 089 | 11/1985 | United Kingdom . |
| 2 166 119 | 4/1986 | United Kingdom . |

*Primary Examiner*—M. Rachuba
*Attorney, Agent, or Firm*—Jones, Tullar & Cooper, P.C.

[57] ABSTRACT

Cutting bars positioned on the peripheral surface of a cutting cylinder are shiftable circumferentially toward or away from each other to vary the lengths of signatures being produced when the folding apparatus is switched between collection and no collection production. The cutting bars are shiftable circumferentially in grooves provided on the surface of the cutting cylinder.

11 Claims, 7 Drawing Sheets

DEVICE FOR ADJUSTING A CUTTING STICK FOR A CUTTING CYLINDER OF A ROTARY PRESS

This application is a continuation of application Ser. No. 08/454,198, filed Jun. 19, 1995 now abandoned which is a 371 continuation of PCT/DE93/01210, filed Dec. 17, 1993.

FIELD OF THE INVENTION

The present invention relates to a device for adjusting a cutter bar for a cutting cylinder of a rotary printing press.

DESCRIPTION OF THE PRIOR ART

In connection with a cutting and collecting device for rotary printing presses, it is known from DE-PS 6 71 790 to employ a cutting cylinder which cooperates with a collecting cylinder having three groove bars on its circumference. The device is used for the continuously changing cutting and for collection of two cut pieces which are slightly different in length and which are intended to have equal edge lengths after mutual transverse folding. For this reason, the two cutters of the cutting cylinder are disposed at an angle of slightly more and again slightly less than 180° with respect to each other in the circumferential direction.

A device for adjusting a cutter bar of a cutting cylinder in the folding unit of a rotary printing press is known from EP 03 64 864 A2. Different cutting lengths of the cut pieces can be adjusted since the cutting cylinder with two cutters disposed on the circumference consists of an inner and an outer cylinder, both of which can be adjusted in the circumferential direction. This is accomplished by means of an additional second wheel train disposed on the press frame. In this case, the extra outlay of press elements as well as an increase in the structural volume is disadvantageous.

SUMMARY OF THE INVENTION

It is the object of the invention to provide a device for adjusting the two cutter bars of a cutting cylinder of a folding unit.

The device for adjusting cutter bars on a cutting cylinder in accordance with the present invention is usable to accomplish the transverse cutting of a paper web train prior to its entry into a folding apparatus. The cutting cylinder can be switched between collection and no collection. The cutter bars are movable selectively toward or away from each other about the circumference of the cutting cylinder while remaining parallel to the axis of rotation of the cutting cylinder. This allows the cutting cylinder to produce signatures having the same or differing lengths. A groove and a cooperating pin engaging the groove may be provided as the adjustment device for the cutter bars on the cutting cylinder. The groove and the pin are disposed so they perform a relative movement with respect to each other.

The following advantages in particular are attained by the invention. The structural size of the device is not increased by an actuating element for adjusting the cutter bars disposed outside of the lateral frame. The device can be easily operated from the operating side of the press and has cost-effective structural elements. In the course of a change of the folding unit from dual production to collective production and vice versa, the device can be easily reset from long-long cutting to long-short cutting. A continuous adjustment is also possible.

BRIEF DESCRIPTION OF THE DRAWINGS

The invention will be described in detail by means of several exemplary embodiments. The associated drawings show in.

DESCRIPTION OF THE PREFERRED EMBODIMENTS

Figure 1:
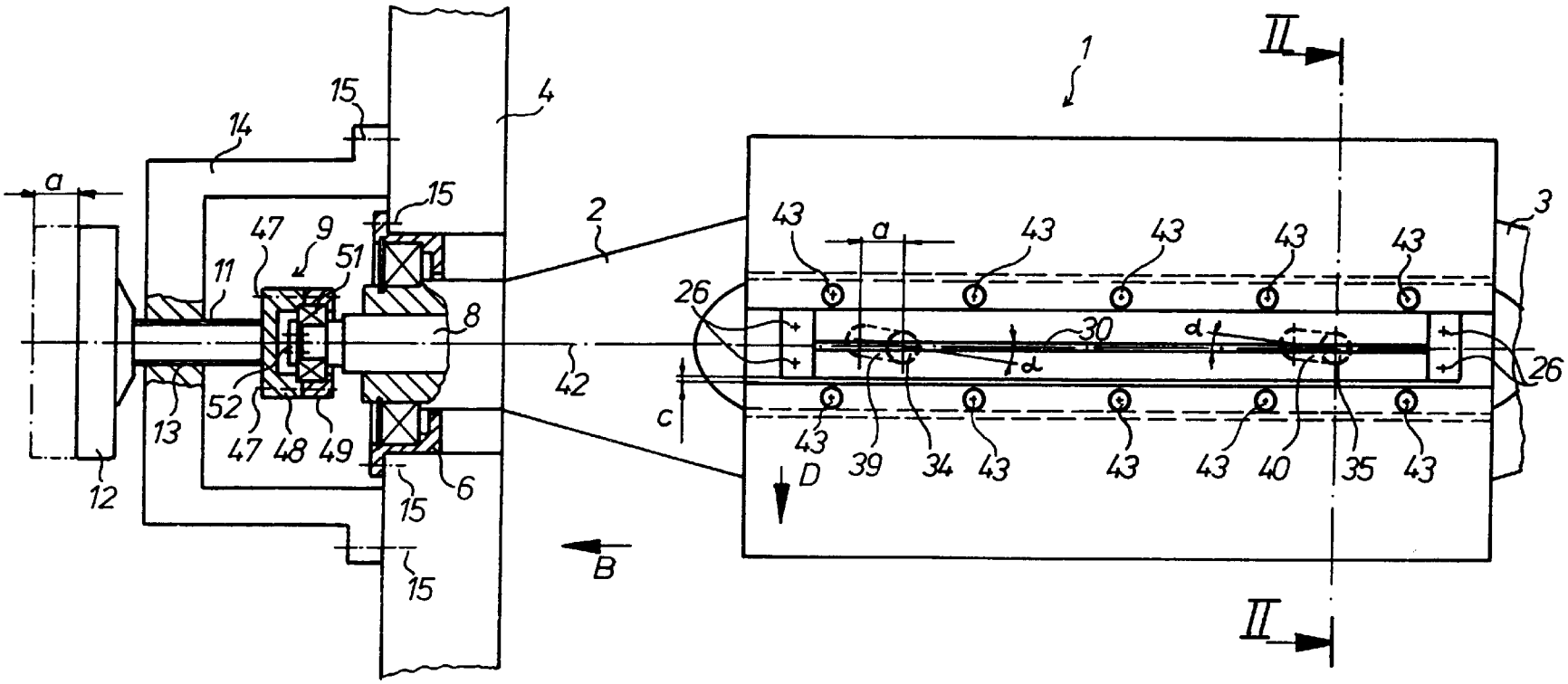
FIG. 1, a top view of a cutting cylinder.
Figure 2:
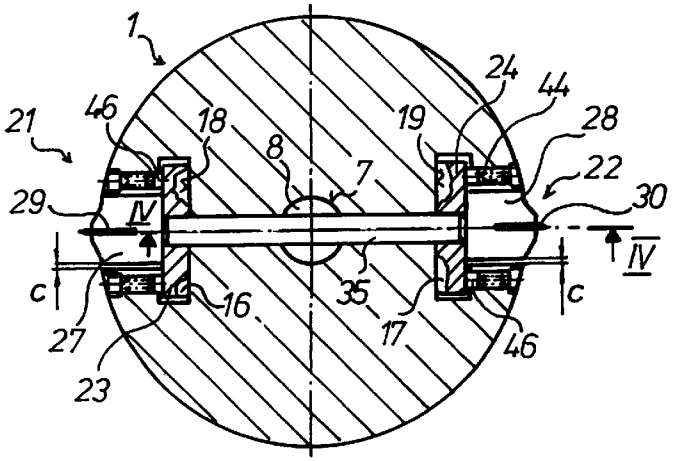
FIG. 2, a cross-sectional view taken along line II—II of FIG. 1.

A cutting cylinder 1—as represented in FIG. 1—is seated by means of its axle journals 2, 3 in lateral frames, of which only the left lateral frame 4 is shown. The axle journal 2 is seated in a cylindrical roller bearing 6, which is designed as a movable bearing. A lifting spindle 8 is disposed in a centered bore 7 of the cutting cylinder 1, as seen in FIG. 2 and is movable over a lift length "a" in the axial direction. Lifting spindle 8 is connected outside of the axle journal 2 and on the far side of the left lateral frame 4, with a manipulator, for example a hand wheel 12, via a coupling 9 and a threaded spindle 11. The threaded spindle 11 extends through a threaded bore 13 of a pillow block 14 fixed on the frame 4. The cylindrical roller bearing 6 as well as the pillow block 14 are disposed fixedly to the frame by means of screws 15, for example cap screws. The bore 7 has an appropriate fit, so that the seating play between the lifting spindle 8 and the bore 7 is minimized.

The cutting cylinder 1 has—as represented in FIG. 2—two grooves or channels 16, 17 with bottoms 18, 19 on its circumference. These first and second grooves or channels 16 and 17 are diametrically opposed to each other and extend in a direction parallel to an axis of rotation of cutting cylinder 1. Cutter bars 21, 22 are disposed in these channels 16 and 17. The first and second cutter bars 21, 22 respectively each comprise a guide strip 23 or 24, disposed on the bottom 18, 19 of the groove or channel 16, 17, and having a rectangular cross section. A cutter insertion bar 27, 28 which each is supporting in an axis-parallel direction respectively one cutter 29, 30 projecting from the cutter insertion bar 27, 28, is frictionally and interlockingly connected with the guide strip 23, 24 by means of screws 26, for example cap screws. The guide strips 23, 24 can be embodied in one piece together with the cutter insertion bars 27, 28.

Figure 4:
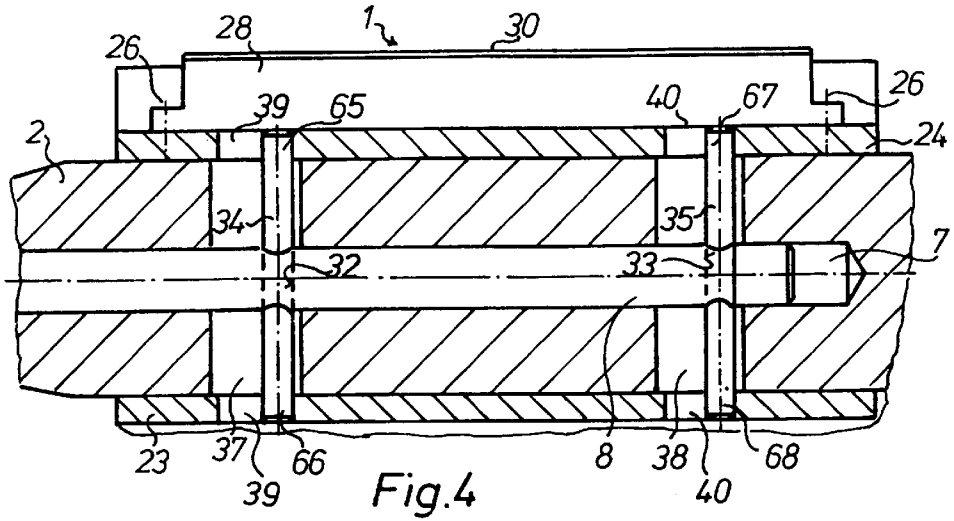
FIG. 4, a partial cross-sectional view taken along line IV—IV of FIG. 2, represented turned by 90°.

As may be seen FIGS. 2 and 4, the portion of the lifting spindle 8 inside the cutting cylinder 1 has two bores 32, 33 extending in a radial direction, through which first and second stay bolts or pins 34, 35 respectively extending in the radial direction are disposed on both sides.

A pair of diametrically extending first and second channels 37, 38 in which the stay bolts 34, 35 are situated, extend from the centered bore 7 in the radial direction. The stay bolts 34, 35 have outer ends which engage grooves 39, 40 having round ends and which grooves 39, 40 are arranged in the guide strips 23, 24 of the cutter bars 21, 22. The grooves 39, 40 can be embodied as elongated holes.

Figure 3:
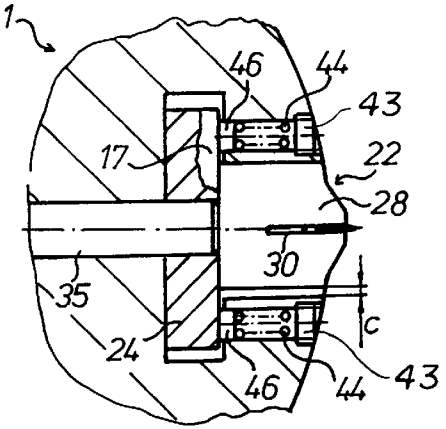
FIG. 3, an enlarged representation of a portion of a cutter bar of FIG. 2.

The grooves 39, 40 in the guide strips 23, 24 extend at an angle $\alpha$ of a size in the range between 2° to 10° in respect to an axial center line 42 of the cutting cylinder 1—as shown in FIG. 2. The illustrations represented in FIGS. 1 to 3 show the cutters 29, 30 in the position of "no collection production", i.e. the cutters extend in alignment with the center lines 42. Screws 43 extend in the axis-parallel direction in respect to the stay bolts 34, 35 and are disposed in threaded bores on both sides of the groove 16, 17 in the jacket surface of the cutting cylinder 1. These screws 43 are provided to reduce the seating play of the guide strips 23, 24 fastened to the cutter bars 21, 22, and to press a sliding block 46, via a compression spring 44 indicated in FIGS. 2 and 3, against the guide strip 23, 24, so that the guide strip 23, 24 is pressed against the bottom 18, 19 of the groove 16, 17.

The sliding blocks 46 can be made of hardened steel or preferably of brass, so that no wear occurs between the sliding blocks 46 and the guide strips 23, 24. The sliding blocks 46 are pressed against the guide strips 23, 24 with an amount of pressure which is slightly greater than the centrifugal forces acting in the opposite direction on the cutter bars 21, 22 when the cutting cylinder 1 rotates.

The coupling 9 is disposed between the lifting spindle 8 and the threaded spindle 11 and consists of a two-piece bearing housing 48, 49 connected by means of screws 47. This two piece bearing housing 48, 49 constituting the stator, whose first element 48 is frictionally and interlockingly connected with the threaded spindle 11. The first end of the lifting spindle 8 extending from the axle journal 2 of the cutting cylinder 1 is seated in the interior of the bearing housing 48, 49 in a rolling bearing 51, for example an axial roller bearing 51. This first end of lifting spindle 8 is kept in place by a screwed-on cover plate 52. The lifting spindle 8 rotates along with the rotation of the cutting cylinder 1. The coupling 9, with its two-piece bearing housing 48, 49 as well as the threaded spindle 11 or stator, is fixedly connected with the first bearing housing element 48 to remain fixed to the frame and acts as a drive for the stay bolts.

If it is now intended to switch the cutters 29, 30 from "no collection production" to "collection production", in which two cut pieces of different length are being created, the lifting spindle 8 is shifted in the axial direction of the arrow B by an amount "a" by turning the hand wheel 12 in a counterclockwise direction. This is shown by means of the dashed representation of the hand wheel 12 in FIG. 1, which had been moved by the amount "a" in the direction B. A circumferential movement of both of the cutter bars 21, 22 disposed in the grooves or channels 16, 17 by an amount or displacement "c" of approximately 2.5 mm both in the direction of the arrow D is performed due to the axial movement of both stay bolts 34, 35 along the center line 42, also in the direction B. This circumferential movement of the two cutter bars 21 and 22 is a result of the grooves 39, 40 with round ends extending obliquely at an angle $\alpha$ in respect to the centerline 42. Cut pieces are created by means of this circumferential shifting of both cutter bars 21 and 22 which have a cut length of $-2 \cdot c$ on both sides, as well as cut pieces of a cut length of $+2 \cdot c$. The shifting of the two cutter bars 21 and 22, both in the circumferential direction D results in unequal circumferential spacings of the two cutter bars 21 and 22 with respect to each other. The two cutter bars 21 and 22 will no longer be diametrically opposed. Instead, a first arcuate distance between the two will be less than 180° while a second arcuate distance around the cylinder 1 will be more than 180°.

Figure 5:
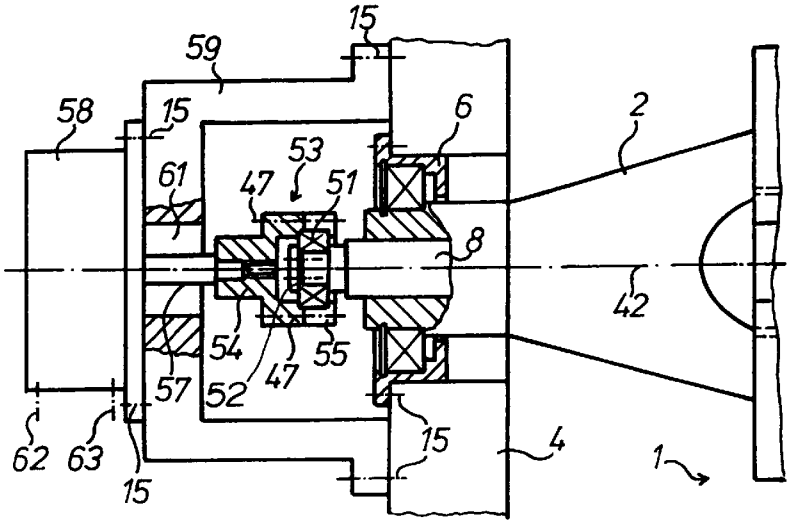
FIG. 5, a second preferred embodiment of a drive for the lifting spindle of FIG. 1.

A second preferred embodiment of a drive for the lifting spindle 8 in accordance with FIG. 1 is shown in FIG. 5. The lifting spindle 8 is connected to a piston rod 57 of a double-acting pneumatic work cylinder 58 through a coupling 53 consisting of a two-piece bearing housing 54, 55 connected by screws 47.

This work cylinder 58 is fastened via a pillow block 59 by respective screws 15 to the left lateral frame 4. Analogous to the coupling 9, in the coupling 53 the end of the spindle lifting 8 extending from the axle journal 2 of the cutting cylinder 1 is seated in a rolling bearing 51, for example an axial roller bearing, and is held by means of a screwed-on cover plate 52, so that when the cutting cylinder 1 rotates, the lifting spindle 8 rotates along with it, while the coupling 53 consisting of its two-piece bearing housing 54, 55, as well as the piston rod 57 fixedly connected with the first bearing housing element 54, remain fixed to the frame. The piston rod 57 is fed through a bore 61 of the pillow block 59. The work cylinder 58 has two connectors 62, 63 for compressed air which are connected via valves, not shown, with a compressed air installation. The ends of the stay bolts 34, 35 pointing in the direction of the jacket surface of the cutting cylinder 1 have been identified by 65, 66; 67, 68 as may be seen most clearly in FIG. 4.

Figure 6:
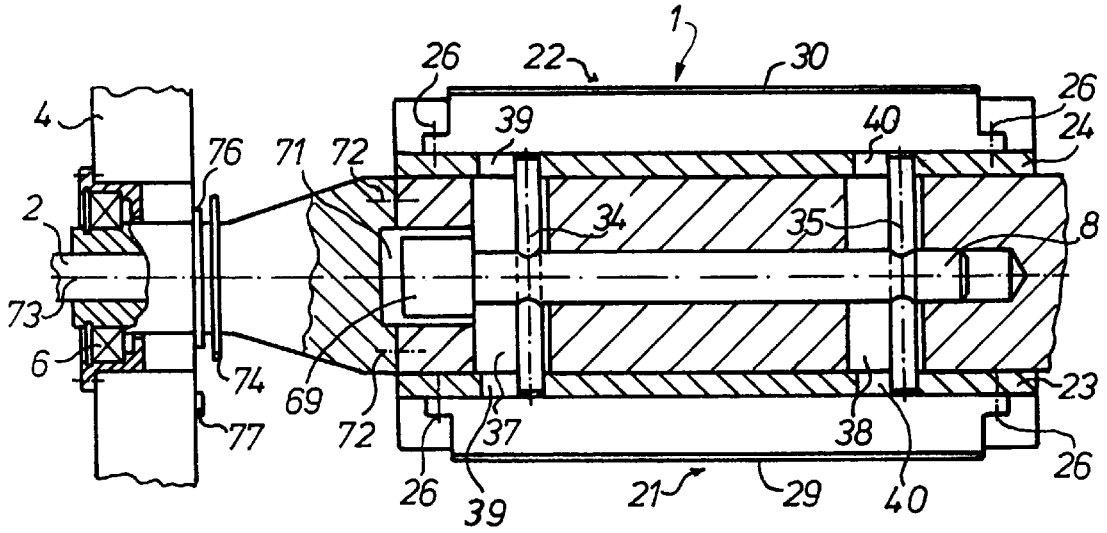
FIG. 6, a third preferred embodiment of a drive for the lifting spindle analogous to a representation of FIG. 4.

A third preferred embodiment of a drive for the lifting spindle 8, which supports the stay bolts 34, 35 and which is movable in an axial direction, is seen in FIG. 6. In this third embodiment the lifting spindle 8 terminates at an electric linear drive or linear motor 69 which motor 69 is disposed in a hollow chamber 71 of the cutting cylinder 1 and exerts a lifting force in the axial direction on the lifting spindle 8. Such a linear motor 69 is described in a brochure of Lintrol Systems (U.K.) Ltd, Loughborough, England. To provide an improved accessibility to the hollow chamber 71, the axle journal 2 can be frictionally and interlockingly connected by means of machine bolts 72 with the front face of the cutting cylinder 1. The transmission of the control pulses as well as the power current for the linear motor 69 can take place via known electrical collector ring systems connected with the axle journals 2, 3. However, it is also possible to transmit the electrical drive energy, commands and pulses in a contactless manner to the rotating cutting cylinder 1. This transmission takes place in such a way that a secondary coil 74 with a secondary electronic device is disposed, for example on an axle journal 2 of the cutting cylinder 1, concentrically with an axis of rotation 73 and cooperates with a primary coil 76 placed at a short distance from— approximately 1 mm—and also disposed fixedly on the lateral frame 4 concentrically with the axis of rotation 73, which in turn is connected with a primary electronic device 77. This primary electronic device 77 can be housed at an arbitrary distance, for example also on the inside of the lateral frame 4. Such a contactless system for transmitting output is offered, for example, by MESA Systemtechnik GmbH of Konstanz.

Figure 7:
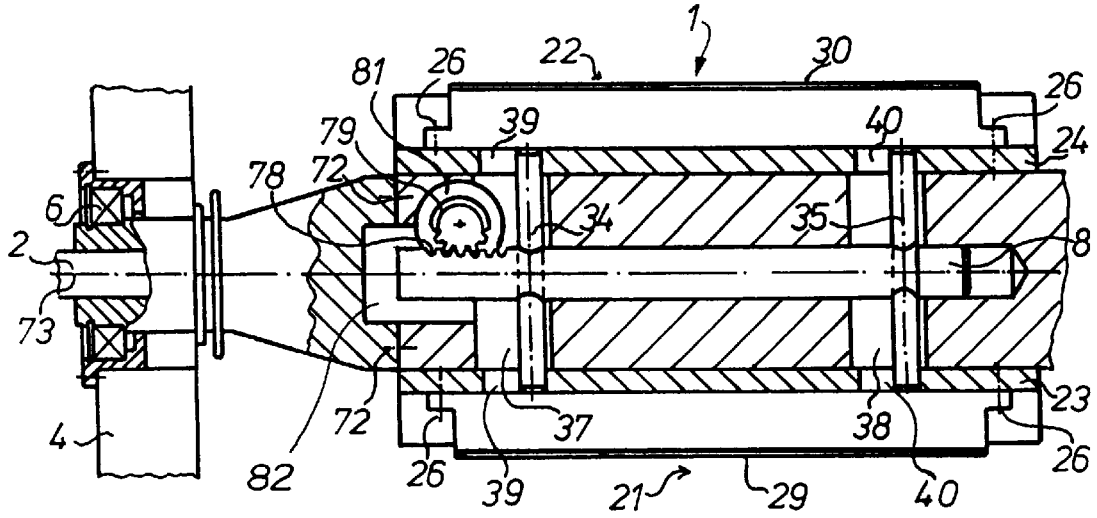
FIG. 7, a fourth preferred embodiment of a drive for the lifting spindle analogous to a representation of FIG. 4.

In accordance with FIG. 7, in a fourth preferred embodiment of a drive for the lifting spindle 8, movable in the axial direction and supporting the stay bolts 34, 35, the lifting spindle 8 also terminates at its first end in the interior of the cutting cylinder 1 and is embodied as a toothed rack 78 on its first end facing the left axle journal 2. The toothed rack 78 meshes with a pinion gear 79 which, in turn, is frictionally and interlockingly connected with an electric gear motor 81 disposed fixed on the cylinder. As already described in connection with FIG. 6, transmission of the control pulses as well as the power current can take place either via generally known electrical collector ring systems, as well as by means of contactless output transmission as already described above. The gear motor 81 and the pinion gear 79 connected therewith are housed in a hollow chamber 82 of the cutting cylinder 1, which is accessible via the axle journal 2 that is screwed to the front face of the cutting cylinder 1, for example.

Figure 8:
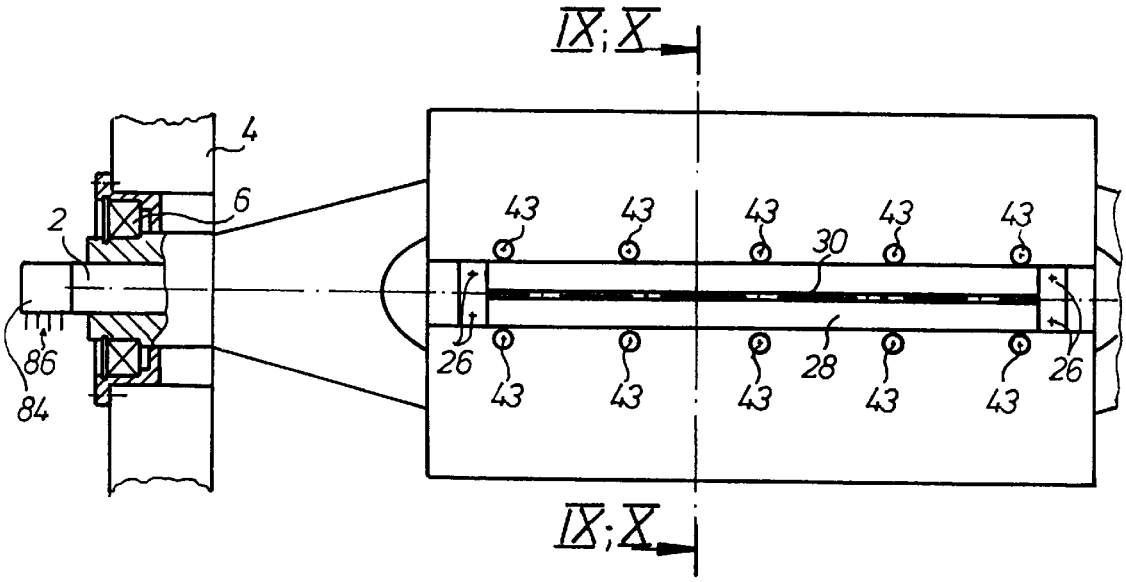
FIG. 8, a top view of a cutting cylinder with fifth and sixth preferred embodiments of a drive for a device for adjusting a cutter bar.
Figure 9:
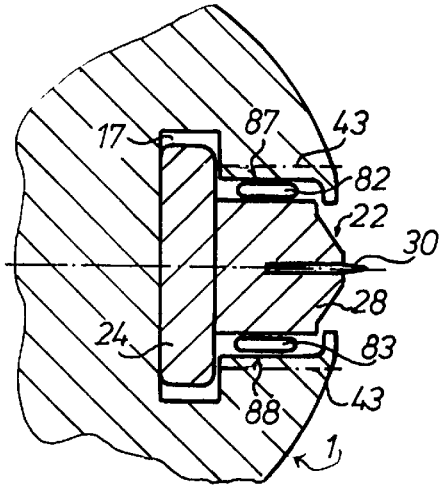
FIG. 9, a section IX—IX of FIG. 8 with the fifth preferred embodiment.

A second cutter bar 22 which, in accordance with FIGS. 8 and 9, in a fifth preferred embodiment consists of a cutter insertion bar 28 and a guide strip 24, fastened to it by screws 26, is run in the groove or channel 17 extending in the axial direction and is held in the groove or channel 17, open at one side, of the cutting cylinder 1 by means of the screws 43, compression springs 44 and sliding blocks 46 shown in detail in FIG. 3. Hoses 82, 83 are disposed on both sides of to the cutter insertion bar 28 and are connected for the introduction of compressed air by means of connecting hoses, not shown, in the axle journal 2 with a revolving connector 84, known from DE 39 43 119 C1, which is fastened on the axle journal 2 of the cutting cylinder 1. The revolving connector 84 has, for example, four compressed air connections, identified as a whole by 86, which are supplied with compressed air from a compressed air installation at a pressure of preferably 6 to 8 bar via valves, not shown. The second cutter bar 22 can be moved back and forth in the circumferential direction of the cutting cylinder, i.e. in both directions, by alternating charging of the hoses 82 or 83 with compressed air. In the course of this, the hose 82 is supported on a first lateral wall 87 of the groove or channel 17 and the hose 83 on a second lateral wall 88 located opposite the lateral wall 87. It is possible to continuously change the cutter bar 22 in the circumferential direction in accordance with production requirements. The same also applies correspondingly for the actuation of a first cutter bar 21 of the cutting cylinder 1.

Figure 10:
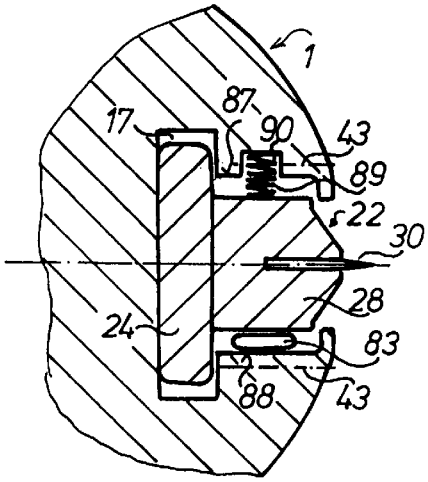
FIG. 10, a section X—X of FIG. 8 with the sixth preferred embodiment.

In a sixth preferred embodiment it is also possible to replace one of the hoses 82 or 83, for example the hose 82, with springs 89 in accordance with FIG. 10, which are disposed in blind bores 90 along the first lateral wall 87 and which continuously keep the cutter bar 22 under prestress. The springs 89 can be embodied as cylindrical helical compression springs. By means of a metered charge of compressed air of the hose 83 it is possible to continuously adjust the second cutter bar 22 in the circumferential direction in response to the product requirements. The same also applies correspondingly to the actuation of a first cutter bar 21 of the cutting cylinder 1. In FIGS. 8 to 10, the cutter bar 22 is in a center position, i.e. for cutting of cut pieces of different length having an average difference in length.

Figure 12:
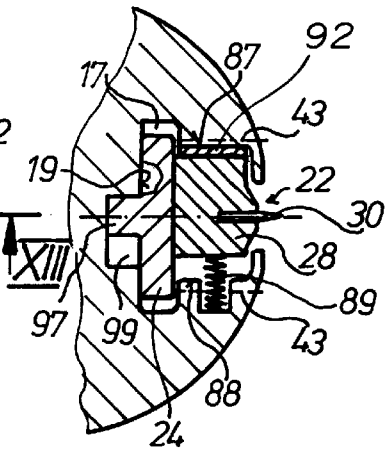
FIG. 12, a section XII—XII of FIG. 11.
Figure 11:
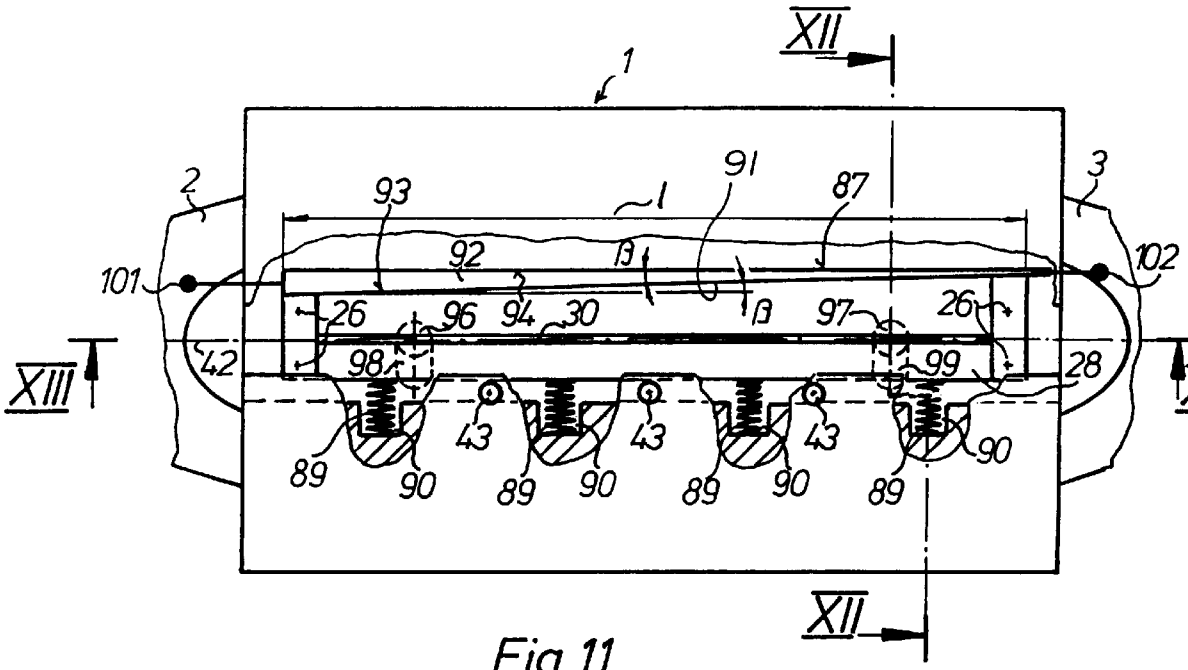
FIG. 11, a top view of a cutting cylinder with a seventh preferred embodiment of a device in accordance with the present invention.
Figure 13:
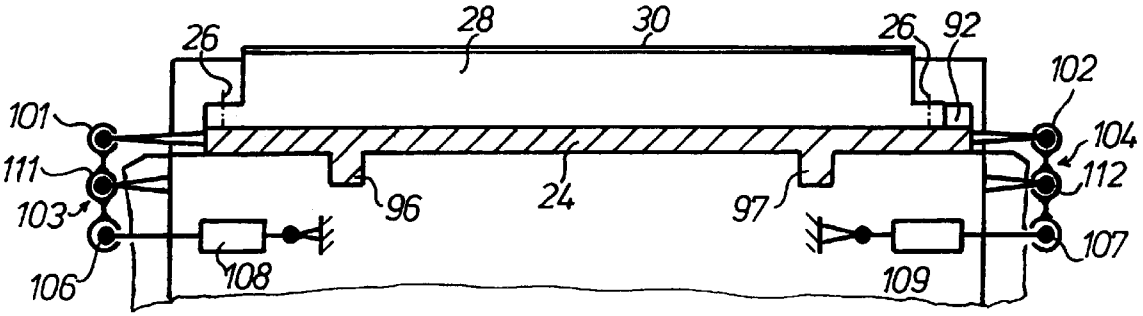
FIG. 13, a section XIII—XIII of FIG. 11.

In a seventh preferred embodiment, as seen in FIGS. 11, 12 and 13, a cutter bar 22 is disposed in a groove or channel 17 with first and second lateral walls 87, 88 and a bottom 19 of a cutting cylinder 1. On its side facing the first lateral wall 87 of the groove or channel 17, the cutter bar 22 has a first lateral face 91 rising one-sidedly in a wedge shape at a wedge angle β over its entire length 1 in FIGS. 11 and 12. A strip 92, embodied wedge-shaped on one side and having a face 93, is disposed between the lateral wall 87 of the groove 17 and the wedge-shaped first lateral face 91, and also rises at an angle β with respect to the horizontal center line 42. The face 93 of the strip 92 faces the wedge-shaped rising side 91 of the cutter bar 22 in a complementary manner, so that both angles β result in a complementary straight line which corresponds to a back 94 of the strip 92 resting against the first lateral wall 87 of the groove or channel 17. On its side facing the bottom 19 of the groove 17, the cutter bar 22 has two pins 96, 97, which are in frictional and interlocking connection with two grooves 98, 99 extending in the circumferential direction of the cutting cylinder 1 in the bottom 19 of the groove 17 and terminating in round ends. The second lateral wall 88 of the groove 17 has two blind bores 90 in which springs 89 are disposed which keep the cutter bar 22 continuously under prestress. The springs 89 can be designed as cylindrical helical pressure springs. The wedge strip 92 is provided with respective links 101, 102 at is end faces, which are respectively frictionally connected via a two-armed lever 103, 104 and a further link 106, 107 with actuator means 108, 109 fixed on the cylinder 1. Each two-armed lever 103, 104 is supported approximately in the center by a bearing 111, 112 fixed on the cylinder 1. The actuator means 108, 109 are used for shifting the wedge-shaped strip 92 in the axial direction, so that the cutter bar 22 performs a motion in the circumferential direction of the cutting cylinder 1. The pins 96, 97 and the grooves 98, 99 assure a parallel guidance of the cutter bar 22. It is also possible to dispose the pins 96, 97 fixed on the cylinder and the grooves 98, 99 in the cutter bar 22. The actuator means 108, 109 can be a known electromagnet, a linear motor 69, a gear motor 81 with a pinion gear 79 engaging a toothed rack 78, a work cylinder 58 or a piezoelectric force transducer. The last mentioned piezoelectric force transducers are described in Dubbel, "Taschenbuch für den Maschinenbau" [Mechanical Engineering Handbook], Volume 17, published by Springer, Berlin, Heidelberg, New York, London, Paris, under Index No. V14, Item 1.5.3 and Index No. W12, Item 2.5.1. The force transducer is manufactured in "sandwich construction" and has, for example, three metal plates disposed at a distance from each other and extending parallel with each other, between which the piezoelectric force generators are located. If now the force generators are charged with a d.c. voltage via the metal plates, wherein the metal plate disposed in the center between the force generators must always have a different polarity than the two metal plates resting from the outside against the force generators, the thickness or distance between the metal plates is changed either positively or negatively, depending on the above mentioned polarity. What was just said in connection with the displacement of the cutter bar 22 also applies to the displacement of the second cutter bar 21 disposed on the circumference of the cutting cylinder 1.

Figure 15:
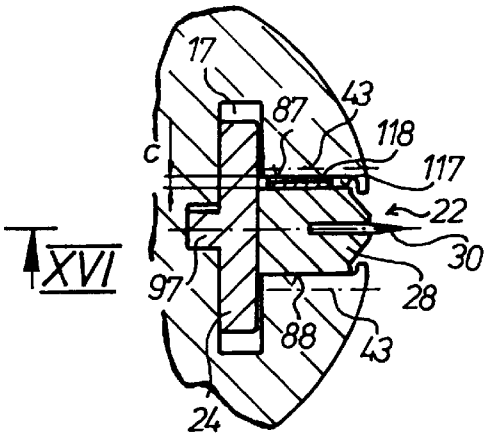
FIG. 15, a section XV—XV of FIG. 14.
Figure 14:
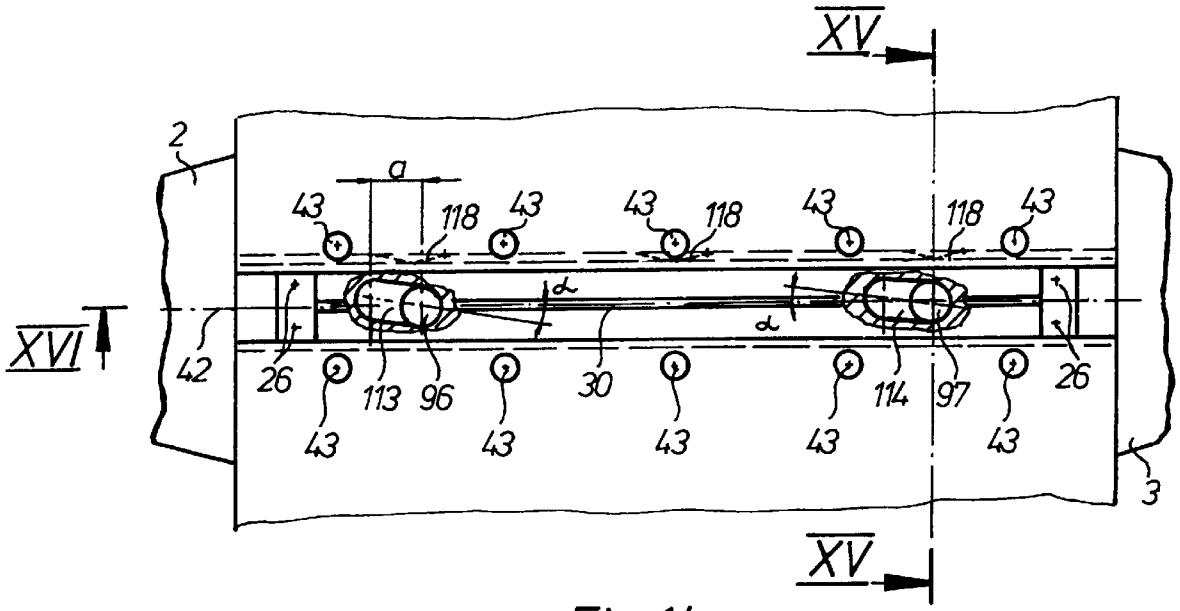
FIG. 14, a top view of a cutting cylinder with an eighth preferred embodiment of a device.
Figure 16:
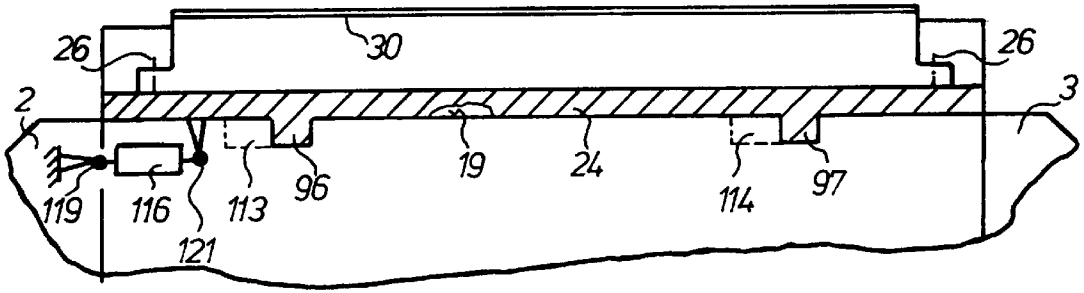
FIG. 16, a partial section XVI—XVI of FIG. 14.

As shown in FIGS. 14 to 16, in an eighth preferred embodiment of the device, a guide strip 24 of a cutter bar 22 is disposed in a groove or channel 17 extending in an axial direction. To cause a movement of the cutter bar 22 in the circumferential direction, the side of the cutter bar 22 facing the bottom 19 of the groove or channel 17 has pins 96, 97 of the same material, which frictionally and interconnectedly engage grooves 113 and 114 with round ends extending in the bottom 19 at an angle α in respect to a center line 42 of the cutting cylinder 1.

Actuation of the cutter bar 22 in an amount "a" in the direction of the angle α extending in respect to the center line 42 of the cutting cylinder 1, so that maximally a displacement "c" of the cutter bar 22 in the circumferential direction of the cutting cylinder 11 will be achieved, and takes place by actuation means 116 fixed on the cylinder. Springs 118, preferably leaf springs, are disposed, frictionally connected on one side, between a first lateral wall 87 of the groove 17 and a long-axially extending side 117 of the cutter insertion bar 28 which are connected, for example by grooved dowel pins, with the first lateral wall 87 of the groove 17. Because of this, the cutter bar 22 is under continuous prestress. The actuator means 116 can comprise a known electromagnet, a linear motor 69, a gear motor 81 with a pinion gear 79 engaging a toothed rack 78, a work cylinder 58 or a previously described piezoelectric force transducer, and it is fixed on the cylinder via a bearing 119 and frictionally connected with the underside of the guide strip 24 via a bearing 121. Second actuator means 116, 113, 119 can be disposed on the opposite end face of the cutter bar 22. As already described, energy transfer can take place, in the case of compressed air, by means of revolving connectors 86, or for electrical energy by means of a known collector ring system or by means of contactless output transmitting systems 74, 76, 77. This applies correspondingly also to the actuation of a second cutter bar 21 disposed on the circumference of the cutting cylinder 1.

Figure 18:
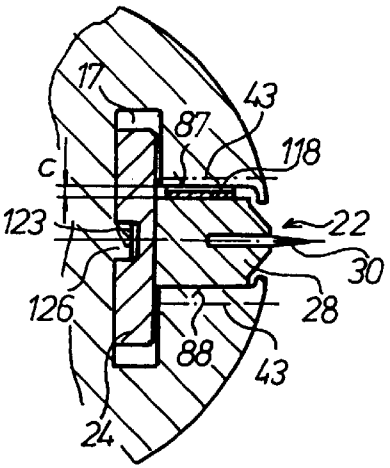
FIG. 18, a section XVIII—XVIII of FIG. 17.
Figure 17:
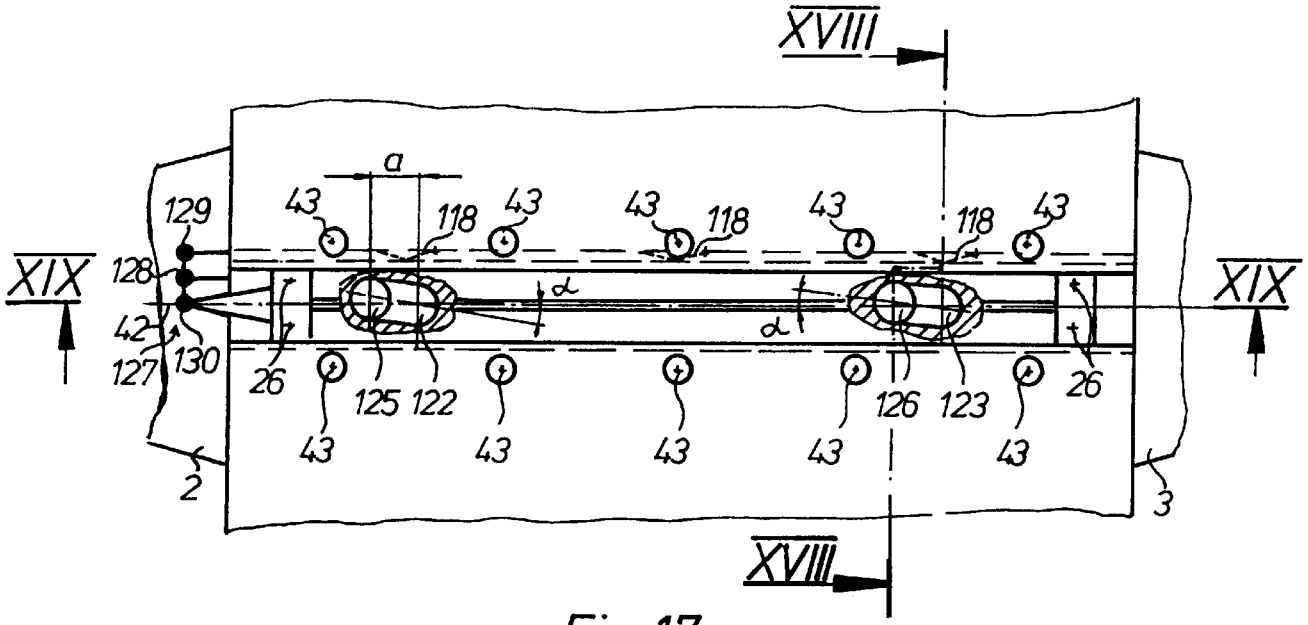
FIG. 17, a top view of a cutting cylinder with a ninth preferred embodiment of a device.
Figure 19:
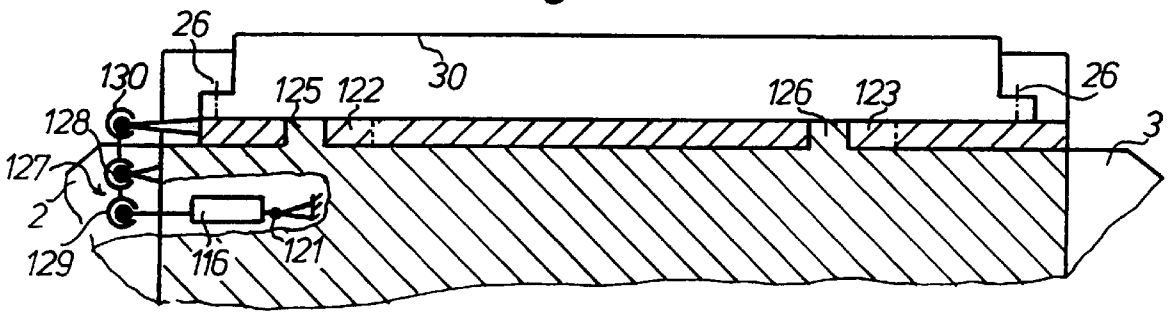
FIG. 19, a partial section XIX—XIX of FIG. 17.

As represented in FIGS. 17 to 19, in a ninth preferred embodiment of the device in accordance with the present invention the guide strip 24 of a cutter bar 22 is disposed in an axially extending groove or channel 17. To obtain a movement of the cutter bar 22 in the circumferential direction, the side of the cutter bar 22 facing the bottom 19 of the groove 17 has two grooves 122, 123 with round ends, which are frictionally and interlockingly engaged by pins 125, 126 fixed on the cylinder. The grooves 122, 123 extend at an angle α in respect to a center line 42 of the cutting cylinder 1.

Actuation of the cutter bar 22 in an amount "a" in the direction of the angle α extending in respect to the center line 42 of the cutting cylinder 1, so that maximally a displacement "c" of the cutter bar 22 in the circumferential direction of the cutting cylinder 11 will be achieved, and takes place by actuation means 116 fixed on the cylinder. Analogous to the representation in FIGS. 14 and 15, springs 118, preferably leaf springs, are provided to keep the cutter bar 22 prestressed. It is possible to use the same actuator means 116 as in the eighth preferred embodiment in FIGS. 14 to 16 with an arrangement via bearings 119, 121. It is also possible to frictionally connect the actuator means 116 of FIG. 18 and FIG. 19 via a two-armed lever 127 disposed at the end face of the cutting cylinder 1 with the cutter bar 22 or the associated guide strip 24. The two-armed lever 127 is held approximately in the center by a bearing 128 fixed on the cutting cylinder and has respective links 129, 130 at its ends. Second actuator means 116, 121, 130, 128, 129 can be disposed on the opposite end of the cutter bar 22. Energy transfer can also take place as already described. This applies correspondingly also to the actuation of a second cutter bar 21 disposed on the circumference of the cutting cylinder 1.

It should be expressly noted that the principle of "an angled groove 39, 40; 113, 114; or 122, 123 in connection with a pin 65, 67; 66, 68; 125, 126 engaging the groove 39, 40; 113, 114; or 122, 123" for displacing the cutter bars 21, 22 in the direction of the circumference of the cutting cylinder 1 is based on the principle of the "inclined plane". In the process, depending on the actuation direction of the cutter bars 21, 22, respectively one portion of the circumference of a pin 65, 67; 66, 68; 125, 126 is supported on a first or inner "angled" guide face or on a second or outer "angled" guide face of the groove 39, 40; 113, 114; or 122, 123:

1a) The groove 39, 40 in the guide strip 24 cooperates with a pin 65, 67 movable in an axis-parallel direction (first ends of the stay bolts 34, 35)—FIG. 4—, 1b) The groove 39, 40 in the guide strip 23 cooperates with a pin 66, 68 movable in an axis-parallel direction (second ends of the stay bolts (34, 35)—FIG. 4—, Looking in the direction of viewing of the top view of the cutting cylinder 1 in FIG. 1, the grooves 39, 40 of the guide strip 23 extend congruently with the grooves 39, 40 in the guide strip 24, since a movement of the stay bolts 34, 35 in the axial direction 42 causes a movement of the cutter bars 21, 22 toward each other.

2) A groove 113, 114, fixed on the cylinder, is respectively located in the bottom 18, 19 of the cylinder trough 16, 17 and cooperates with pins 96, 97, respectively disposed on the cutter bar 21, 22 or preferably the guide strip 23, 24—FIG. 14—.

Here, too, the grooves 113, 114 run in the same direction as described under Item 1b).

3) A groove 122, 123 respectively located in the cutter bar 21, 22 or preferably the guide strip 23, 24 cooperates with respectively two pins 125, 126, fixed on the cylinder and disposed on the bottom 18, 19 of the cylinder trough 16, 17—FIG. 17—.

Here, too, the grooves 122, 123 run in the same direction as described under Item 1b).

4. By means of an axis-parallel movement of a strip 92 with an "inclined plane" 93 against a side of the cutter bar 21, 22 embodied in a wedge-shape, the cutter bars 21, 22 are moved toward or away from each other in the circumferential direction of the cutting bar cylinder 1—FIG. 11—.

Looking in the direction of viewing of the top view in accordance with FIG. 11, the wedge-shaped strip 92 disposed in an axis-parallel direction in the cylinder trough 16, 17 extends congruently above a similar strip 92 in a cylinder trough 16.

While preferred embodiments of a device for adjusting a cutting stick for a cutting cylinder of a rotary press in accordance with the present invention have been set forth fully and completely hereinabove, it will be apparent to one of skill in the art that a number of changes in, for example, the overall size of the cylinder, the length of the cutting stick, the type of cutting blades used, and the like could be made without departing from the true spirit and scope of the present invention which is accordingly to be limited only by the following claims.

What is claimed is:

1. A cutting cylinder comprising:

a circumferential surface on said cutting cylinder;

means for supporting said cutting cylinder for rotation about a cutting cylinder axis of rotation;

first and second channels on said circumferential surface of said cutting cylinder, said first and second channels being diametrically opposite to each other on said circumferential surface of said cutting cylinder, each of said first and second channels extending parallel to said axis of rotation of said cutting cylinder and each having a channel bottom surface with said channel bottom surface defining a channel bottom plane;

a first cutter bar supported circumferential movement on said circumferential surface of said cutting cylinder in said first channel;

a second cutter bar supported for circumferential movement on said circumferential surface of said cutting cylinder in said second channel; and means to move said first and second cutter bars circumferentially in said first and second channels respectively, said means including a cooperating angled groove in one of each said first and second channels and said first and second cutter bars and a pin on the other of each said first and second channels and said first and second cutter bars, each said angled groove lying in said channel bottom plane of said respective one of said first and second channels, and being inclined at an angle to said cutting cylinder axis of rotation, each said cooperating angled groove and pin being in engagement with each other and being shiftable with respect to each other and with respect to said axis of rotation to move each of said first and second cutter bars circumferentially in its first and second channel respectively.

2. The cutting cylinder in accordance with claim 1 wherein each said angled groove is disposed in one of said first and second cutter bars and further wherein each said pin is a stay bolt which is movable in an axial direction of said cutting cylinder, and further including a drive for moving each said stay bolt axially in said cutting cylinder.

3. The cutting cylinder of claim 2 further including stay bolt channels in said cutting cylinder, each said stay bolt being disposed in one of said stay bolt channels, each said stay bolt having a stay bolt head, each said angled groove being located in one of said first and second cutter bars, each said stay bolt head being received in one of said angled grooves.

4. The cutting cylinder in accordance with claim 2 further including a lifting spindle disposed in an axially extending bore in said cutting cylinder, each said stay bolt being connected with said lifting spindle.

5. The cutting cylinder of claim 4 further including a hand wheel mounted for rotation and connected to said lifting spindle, said lifting spindle being axially shiftable in said axially extending bore in said cutting cylinder by rotation of said hand wheel.

6. The cutting cylinder of claim 4 further including a double-acting work cylinder, means for supporting said double-acting work cylinder, and means for connecting said double-acting work cylinder to said lifting spindle.

7. The cutting cylinder of claim 4 further including a linear motor, means for supporting said linear motor and means connecting said linear motor to said lifting spindle.

8. The cutting cylinder of claim 4 further including a toothed rack drive, means for supporting said toothed rack drive, and means connecting said toothed rack drive to said lifting spindle.

9. The cutting cylinder of claim 1 wherein each said angled groove is located in said bottom surface of each said first and second channels, and further including a bottom side of each of said first and second cutter bars, said pin on each said first and second cutter bar being located on said bottom side and being received in said angled groove.

10. The cutting cylinder in accordance with claim 1 further including a first lateral wall for each said first and second spaced channel, and a spring disposed between said first lateral wall and each said first and second cutter bar supported in each said first and second spaced channel, respectively.

11. The cutting cylinder in accordance with claim 1 wherein said angled groove is between 2° and 10° with respect to said axis of rotation of said cutting cylinder.

* * * * *